United States Patent [19]

Hultgren et al.

[11] 4,183,281

[45] Jan. 15, 1980

[54] METHOD OF AND DEVICE FOR LOADING A FIREARM

[75] Inventors: K. Sten R. Hultgren; J. P. Göran Sundmar, both of Karlskoga, Sweden

[73] Assignee: Aktiebolaget Bofors, Bofors, Sweden

[21] Appl. No.: 955,055

[22] Filed: Oct. 26, 1978

Related U.S. Application Data

[63] Continuation of Ser. No. 778,200, Mar. 16, 1977, abandoned.

[30] Foreign Application Priority Data

Mar. 31, 1976 [SE] Sweden ..... 7603851

[51] Int. Cl.[2] ..... F41F 9/06

[52] U.S. Cl. ..... 89/47

[58] Field of Search ..... 89/33 A, 33 B, 45, 46, 89/47

[56] References Cited

U.S. PATENT DOCUMENTS

| | | | |
|---|---|---|---|
| 811,797 | 2/1906 | Schneider | 89/45 |
| 1,128,555 | 2/1915 | Vickers et al. | 89/45 |
| 1,310,890 | 7/1919 | Schneider | 89/47 |
| 3,937,125 | 2/1976 | Erikson | 89/45 |
| 3,938,421 | 2/1976 | Nordman | 89/47 |

FOREIGN PATENT DOCUMENTS

| | | | |
|---|---|---|---|
| 10637 | 8/1909 | France | 89/47 |
| 931240 | 2/1948 | France | 89/47 |
| 15035 | of 1910 | United Kingdom | 89/47 |
| 262858 | 12/1926 | United Kingdom | 89/47 |

*Primary Examiner*—Stephen C. Bentley

*Attorney, Agent, or Firm*—Pollock, Vande Sande & Priddy

[57] ABSTRACT

A novel method and apparatus for loading a projectile and its propellant charge into a firing chamber of a firearm, comprising the steps of: positioning the projectile on a loading tray which is then pivoted into a position coinciding with an axis extending through the firearm barrel, positioning the propellant charge on a carrying member which is then pivoted into a position directly behind the projectile, moving the carrying member toward the barrel chamber to push the projectile into firing position therein, reversing the movement of the carrying member wherein a charge retainer retains the propellant charge in proper position within the firing chamber.

15 Claims, 9 Drawing Figures

A—A
B—B
C—C
14a
14
22
22'
23
24
25
26
27
28
29
10a
12'
11

METHOD OF AND DEVICE FOR LOADING A FIREARM

This is a continuation of application Ser. No. 778,200, filed Mar. 16, 1977 now abandoned.

BACKGROUND OF THE INVENTION

The present invention relates to a method for rapidly loading a firearm whereby a loading tray positioned at the rear portion of the firearm barrel is laterally displaceable in relation to a longitudinal axis of the bore. The method encompasses receiving a projectile (shell or the like) and positioning the projectile and a propellant charge (or the like) in a chamber sealed by means of a closing unit. The invention also comprises a device for carrying out the above stated method.

The present invention is primarily intended for use for large-calibre type firearms, and in view of relevant further developments, the method is particularly suitable for use with field-artillery weapons for which, among other things, there is a requirement that the firearm barrel attain a high angle of elevation.

When loading a barrel chamber with a projectile and a propellant charge there is a special need for rapid loading procedures, in order to provide for a high rate of fire of the firearm. Moreover, propellant charges of different lengths, depending on the range, create problems in obtaining a uniform positioning of the propellant charge relative to an inner surface of the closing unit.

OBJECTS AND SUMMARY OF THE PRESENT INVENTION

A purpose of the present invention is to create a method and device for making an automatized loading procedure possible, wherein the propellant charge assumes its correct firing position in the chamber, independent of its actual length.

A feature indicative of a method according to the present invention is that the propellant charge is initially placed on a carrying member provided for the charge and longitudinally displaceable in relation to the projectile loading tray. The loading tray with the projectile placed on it is swung behind the barrel, or vice versa, and thereafter the carrying member after possibly having been connected together with the loading tray is displaced longitudinally forwards in relation to the loading tray. This action forces the projectile to move off the loading tray towards its position in the bore of the barrel propellant charge remaining in the carrying member is positioned behind the projectile within the firearm, with the carrying member being thereafter longitudinally displaced rearwardly in relation to the loading tray. During the rearward movement of the carrying member the propellant charge contacts with a charge retainer positioned at the rear portion of the barrel which retains the propellant charge in the barrel in a predetermined longitudinal displacement position. This makes it possible to have the propellant charge assume a position relative to an inner surface of the closing unit when in the closed position. The new device includes a carrying member which, after having received the propellant charge, can be positioned behind the loading tray and projectile placed thereon. Because the carrying member is forwardly displaceable in relation to the loading tray, the carrying member causes both the projectile and the propellant charge to be inserted into the firearm. Because the carrying part also rearwardly displaceable from its advanced position, it functions in cooperation with a charge retainer positioned at the rear portion of the barrel to retain the propellant charge during the rearward movement of the carrying member in a predetermined longitudinal position. This makes it possible to have the propellant charge assume a position an inner surface of the closing unit when in the closed position.

A further feature of the present invention is the unique method and structure that allows the field artillery weapon to achieve high angles of elevation.

The structure actuated during the loading procedure is arranged with special designs and in a specific way at the rear portion of a cradle of the firearm, which is supported in a lower carriage assembly. The preferred embodiment also makes it possible for personnel to handle the feeding of projectiles, shells, etc., and propellant charges from the side of the firearm, which is essential from the point of view of safety.

BRIEF DESCRIPTION OF THE DRAWINGS

A preferred embodiment of a device and method according to the present invention will be described in the following, with reference to the accompanying drawings, in which.

DETAILED DESCRIPTION OF A PREFERRED EMBODIMENT

Figure 1:
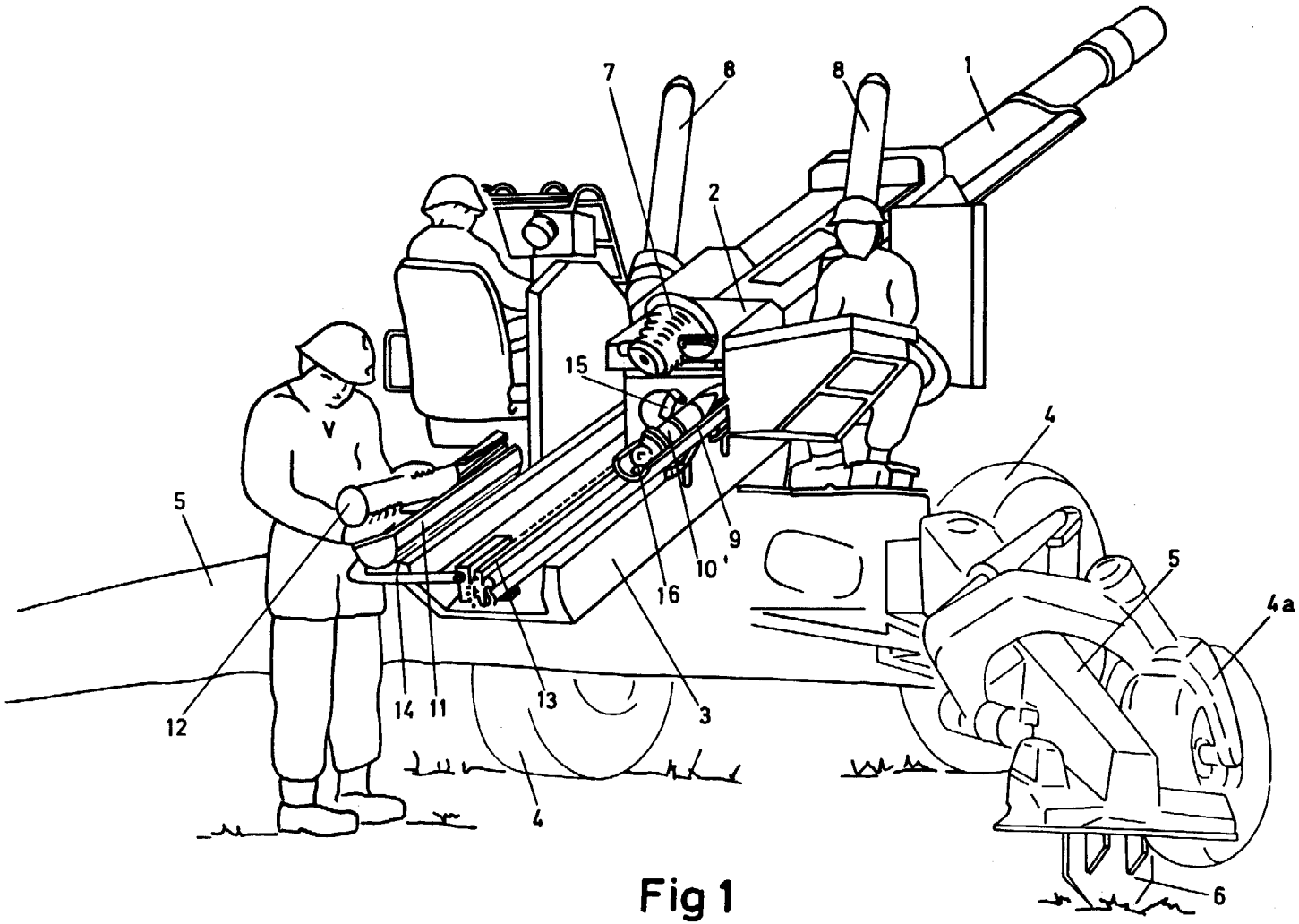
FIG. 1 shows an oblique perspective, of a field-artillery weapon utilizing the present invention.

In FIG. 1, a field-artillery weapon of a known type is illustrated which includes a barrel indicated at 1 and a breech ring indicated by the numeral 2. The firearm is provided with a conventional cradle 3, in which the firearm slides on guide rules during its recoil movement. The weapon runs on wheels, and is therefore provided with a pair of driving wheels 4. Positioned on carriage trails 5 are pivot wheels designated **4*a* which can be raised and lowered, and which in the lowered position pivot freely. The carriage trails 5 are spread and fixed to the ground via trail spades 6, when positioning the weapon in the firing position. At the rear part of the breech ring 2 a closing unit is arranged, which may consist of a screw mechanism 7 formed with a cover and a chamber screw conventionally supported thereon. For opening and closing the breech mechanism, a so-called semi-automatic device is used, of a known kind which is not shown here. The elements controlling the elevation of the barrel are designated at 8**.

At the rear portion of the firearm's cradle 3, loading devices are arranged which provide a rapid and automatic loading procedure. Loading members comprise a loading tray 9 for receiving a projectile 10. The loading tray 9 is locked to the elevating mass of the firearm and can be swung in and out laterally in relation to the longitudinal direction of the firearm. In the position shown in FIG. 1, loading tray 9 receives the projectile 10, and is swung until the axis of rotation of the projectile 10 coincides with an extension of an axis extending through the bore of the firearm, not shown. The loading members also comprise a carrying member 11 for a propellant charge 12, with the powder filled charge 12 supported in a bag made of cloth or the like.

The carrying member 11 for the propellant charge 12 also comprises a rammer head assembly fixed to a rammer car 13, of a type which is known in itself. The running movement of car 13 is geared to achieve high speeds required during the loading procedure. In principle, the carrying member 11 consists of a cradle-formed unit and an arm 14, which includes one end fastened to the cradle-formed unit and includes a further end rotatably supported in the rammer car 13. This allows the cradle-formed unit to rotate laterally along an arc-shaped line between a first position shown in FIG. 1, for receiving the propellant charge 12, and a second position in the extension of the axis of the bore. The rammer car 13 can be run inside the cradle 3 in the longitudinal direction of the firearm between an end or load position shown in FIG. 1 and an advanced position in which the propellant charge 12 is inserted into the chamber of the firearm. The preferred embodiment provides a novel loading structure which extends a limited distance behind the barrel 1 making it possible to achieve high angles of elevation (for example up to 70°). A charge retainer 15 for the propellant charge 12 is positioned at breech ring 2. The loading tray 9 is made with a spring-action stop 16, which prevents the projectile 10 from sliding off the loading tray 9 when the firearm assumed high angles of elevation.

Figure 2:
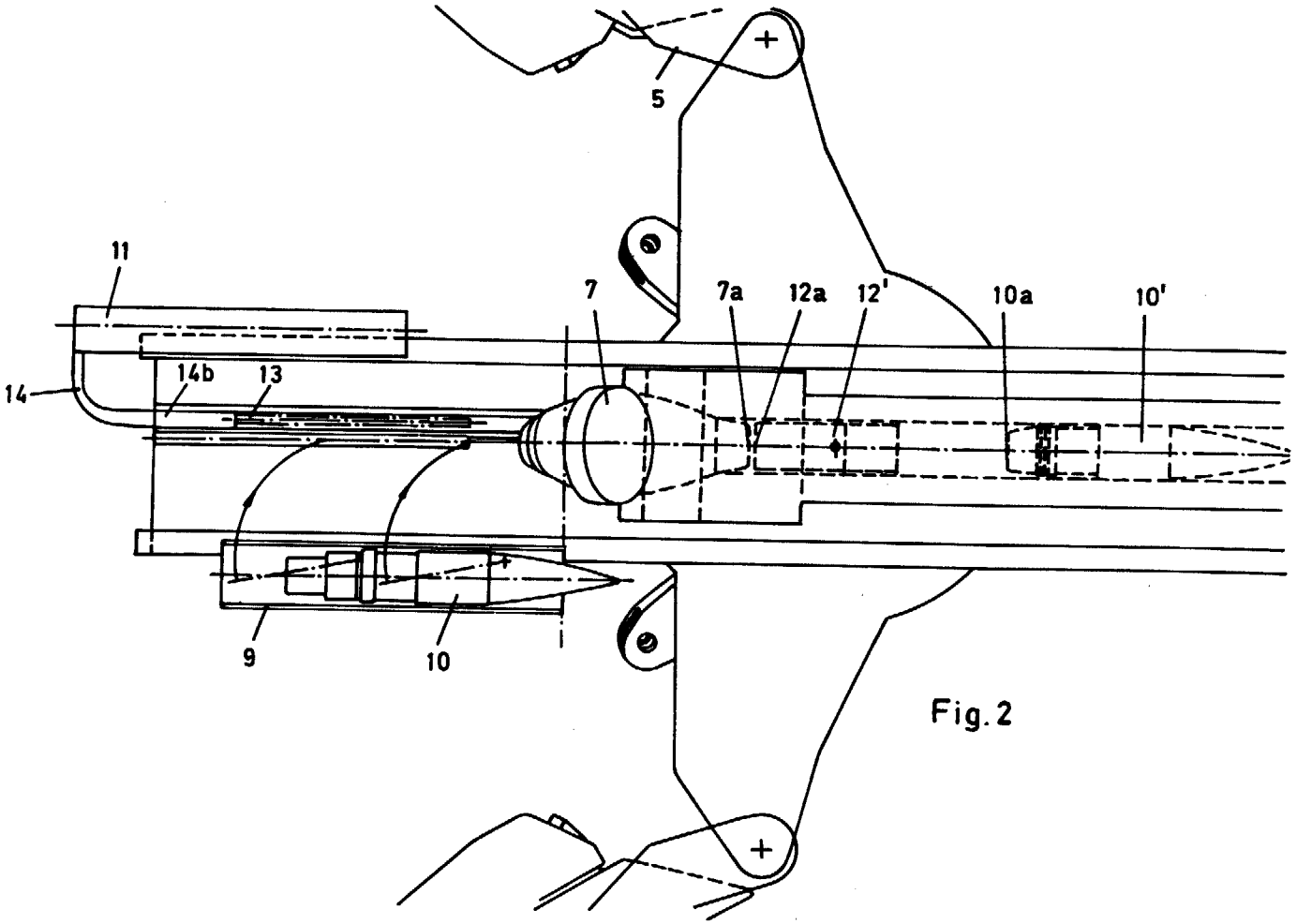
FIG. 2 shows a horizontal view of the weapon according to FIG. 1.

FIG. 2 shows the swinging movement of the loading tray 9 from a side position to a receiving position. Furthermore, the position of the projectile 10 in the bore of the barrel 1 at the origin of the rifling is shown by 10', and the corresponding chamber position of the propellant charge is shown by 12'. The propellant charge 12' can assume various lengths, and, except when it assumes a maximum length, it does not fill up the entire space in the chamber between an obturating surface 7*a* on the screw mechanism 7 and the rear surface 10*a* of the projectile or shell 10. It becomes essential that the propellant charge 12' be placed in the chamber so that one of its end surfaces 12*a* comes close to or against the surface 7*a* of the screw mechanism 7. Otherwise, an unacceptable dispersion of the various projectiles 10 would result during firing. The present invention provides a loading structure and procedure which ensures proper placement of propellant charge 12.

Figure 3:
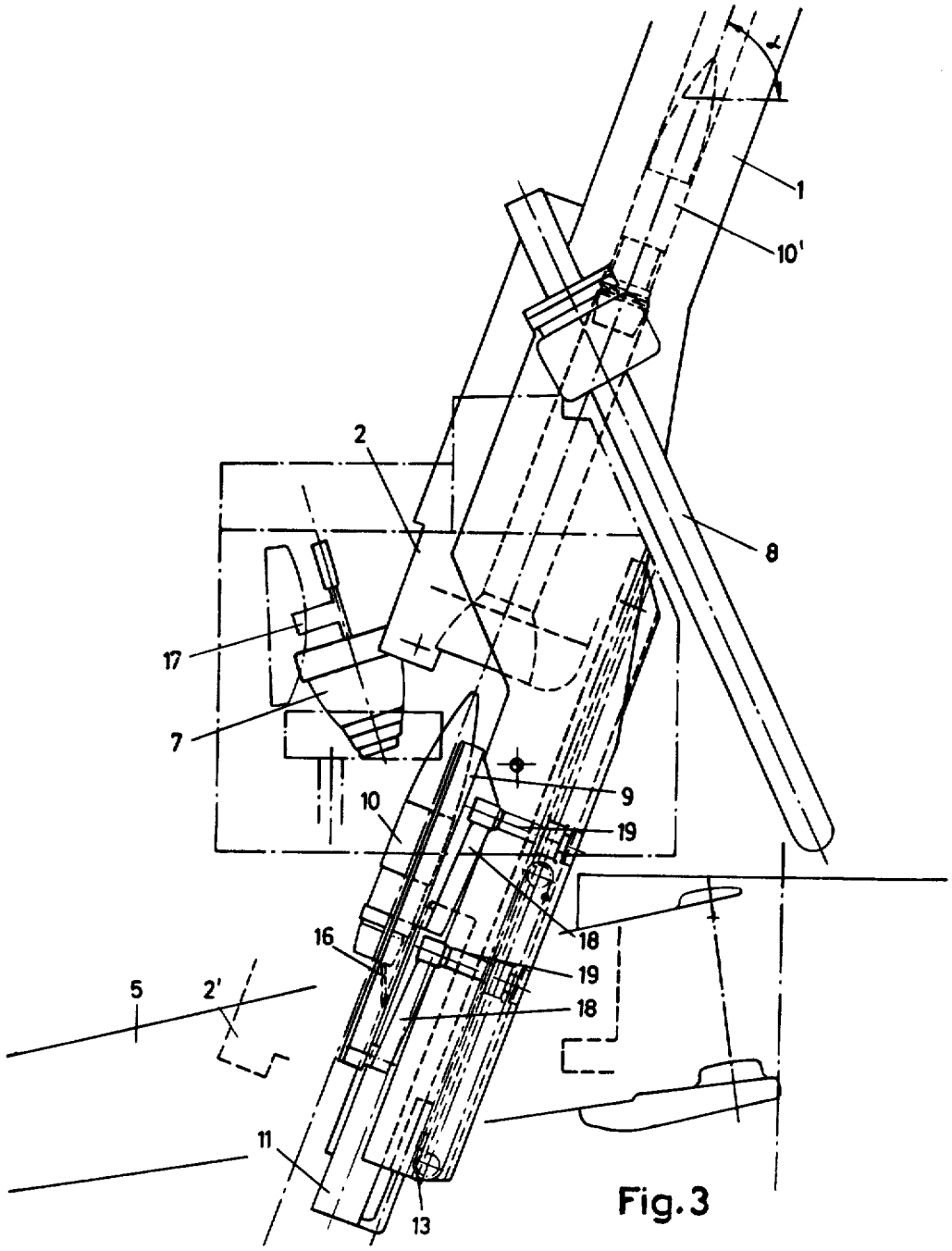
FIG. 3 shows a side view of the weapon according to FIG. 1, with the firearm at the maximum angle of elevation.

FIG. 3 is intended to show parts of the invention described above when the firearm is at the maximum angle of elevation or $\alpha = 70°$. The fully recoiled position of the firearm is designated 2'. As will be noted from FIG. 3, the screw mechanism 7 coacts with an automatic device 17 for loading primers into the relevant position in the screw 7, which is the position shown in the figure.

Figure 4:
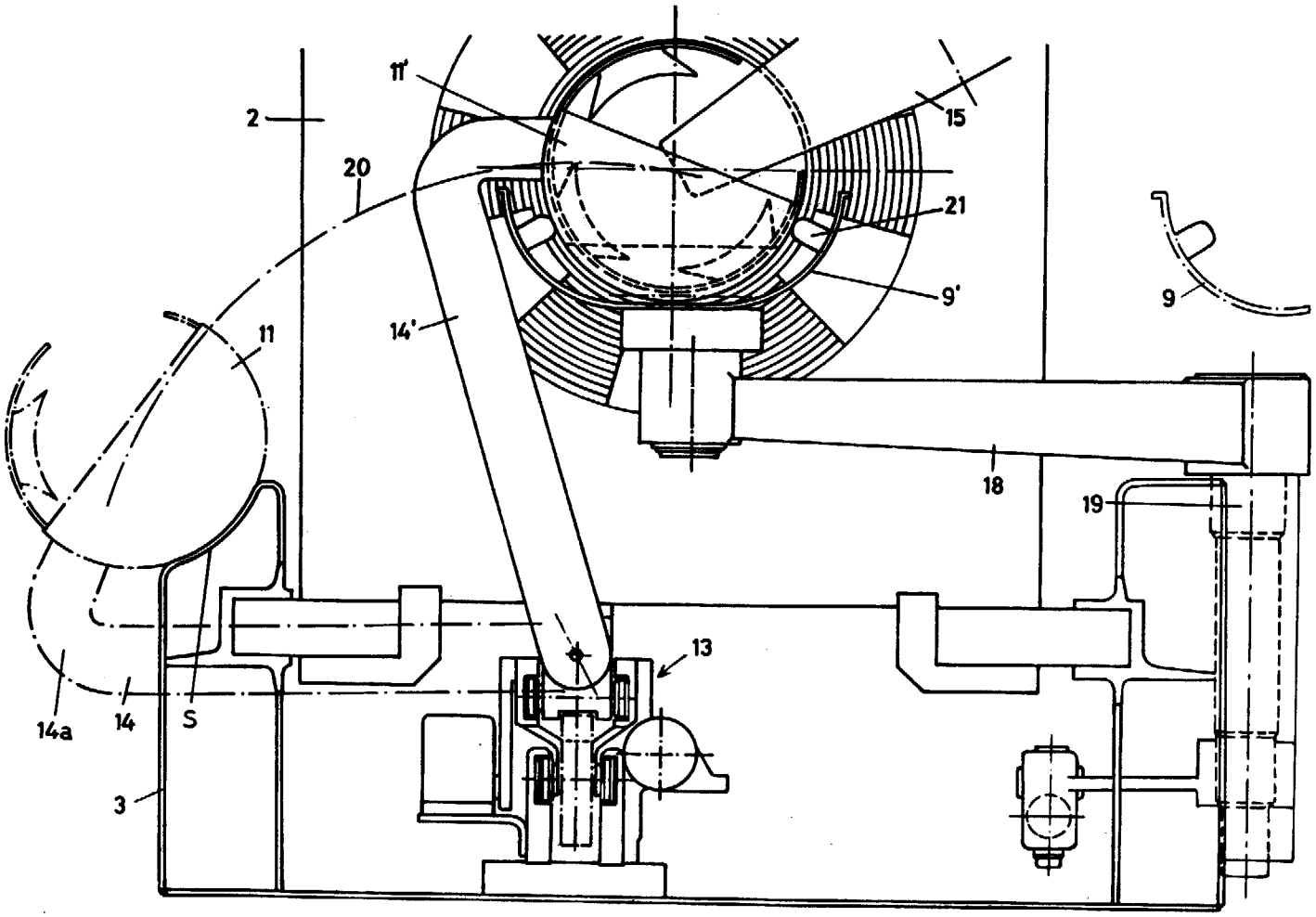
FIG. 4 shows an end view of the field-artillery weapon according to FIG. 1 engaged in the loading procedure.

FIG. 4 shows the preferred embodiment with loading tray 9 swung into its second position 9'. The loading tray 9 is supported in a conventional way on two arms 18 which extend parallel to each other only one arm 18 is shown in FIG. 4, while both arms 18 are shown in FIG. 3. The arms 18 are rotatably arranged in the loading tray 9, and in fixed supports 19, so that the loading tray 9 can be displaced in a lateral direction of and parallel to the firearm. In FIG. 4, the cradle-formed member 11 and the arm 14 are movable to positions 11' and 14' respectively in the extension of the axis of the bore, with member 11 moving along the arc-shaped line 20. As member 11 is swung into loading position, the front parts are moved down into a rear portion of loading tray 9. The loading tray 9 also includes internal guide rails 21, extending in the longitudinal direction of loading tray 9. When member 11 is moved down into the loading tray 9, the propellant charge 12 inserted in member 11 will come into a position behind the projectile 10 positioned in the loading tray 9. The arm 14, which is rigidly fastened in member 11 is made with an angular fastening part 14*a* attached to member 11 which permits arm 14, at the connection with member 11 and the loading tray 9 to extend over one of the side edges of the loading tray 9, whereby tray 9 can be formed with the same height on both sides. The arm 14 is also provided with an angular part 14*b* by means of which it is supported and can be actuated in the rammer car 13. In its side position, member 11 rests in a recess on a supporting part s which abuts the side position thereof.

Member 11 has the form of a circular tube which has been cut in half along its longitudinal direction, and includes a rear end wall. In the position designated at 11, the opening of member 11 is turned somewhat towards the person who is inserting the propellant charge 12, while in the position designated at 11' the opening is turned somewhat away from the same person. The charge retainer 15 functions in connection with the opening of the member 11 when in the second position 11'.

In the position according to FIG. 4, member 11 is intended to be displaced relative to the surrounding loading tray 9, and in its longitudinal direction, i.e. at right angles to the plane of the FIG. 4, with member 11 then sliding on the guide rails 21. The displacement of member 11 takes place by means of the rammer car 13 via the arm 14. During the forward movements, member 11 contacts the projectile 10 in the loading tray 9. Continued movement of member 11 forces projectile 10 off the loading tray 9 and into its firing position in the bore of the barrel 11 while simultaneously positioning the propellant charge 12, along with member 11 behind the projectile 10 in the chamber of the barrel 1.

The ramming speed is comparatively high, approx. 4 m/s, and therefore member 11 may stop before the projectile 10 has reached its end or final position in the bore of the barrel 1. From the stopped position of member 11, the projectile 10 continues via the kinetic energy obtained from member 11 to its end position, i.e. the projectile 10 exhibits free flight to its final position, which is essential for proper ramming, particularly at high elevations.

The carrying member 11 is shown in more detail in FIGS. 5*a*–5*d*, wherein is provided with a part 22 which can be turned down, but which normally is turned up. A spring, not shown in detail, in a support 23 may be provided to position part 22. In its turned-down position, the part 22 assumes the position designated 22' in FIG. 5*a*. In the turned-up position, member 11 can coact with the rear surface 10*a* of the projectile 10, so that projectile 10 can be in a forward direction toward barrel 1 by member 11. The part 22 can be forced to the turned-down position 22*a* by the movement of propellant charge 12' from member 11. The turning-down of the part 22 makes removal of propellant charge 12 possible. In certain cases (for instance at high ramming speeds) it is advisable to form part 22 with a greater length, allowing it to coact with the shell 10 via diametrically opposite points or surfaces on the rear end of the shell.

Part 22 can be designed whereby only shell 10 and propellant charge 12 are necessary for guiding part 22 into position which eliminates the need for any additional spring.

Member 11 includes spring-action members for securing the propellant charge 12, preventing charge 12 from striking the rear surface of the projectile with too hard a force, as a result of the relatively rapid braking action of member 11. This prevents the propellant charge 12 from being deformed or unnecessarily damaged. However, the spring-action members are structured to permit the retaining of the propellant charge 12 when charge 12 coacts with the charge retainer 15 during the subsequent rearward movement of member 11.

The spring-action members comprise a first circular holder 24 in the cross-section of the unit, which holder has the form of a band which in the transversal direction extends along an extension of a circular cross-section. This allows the band to extend partly around the parts of the propellant charge 12 which are not covered by member 11. The first holder is provided with three forwardly extending spring elements 25, one of which extends from a free standing part of the holder, while two springs extend from the part fastened inside member 11. The last-mentioned two spring elements can also possibly be fastened directly in the inner surface of member 11. The spring elements are substantially symmetrically positioned along the periphery of the holder, and are inclined forwardly and inwardly, having a length which is approx. ¼ of the total length of member 11. The spring elements, moreover, widen toward their forward; or free ends. Member 11 is also provided with a second holder 26 which has a design corresponding to that of the first holder 24. However, holder 26 is provided with only two forwardly extending spring elements, which have a considerably shorter longitudinal length than the first-mentioned spring elements. The latter spring elements are indicated at 27 and are fastened to the parts of the holder 26 which are fastened in member 11.

Figures 5A, 5B, 5C, 5D:
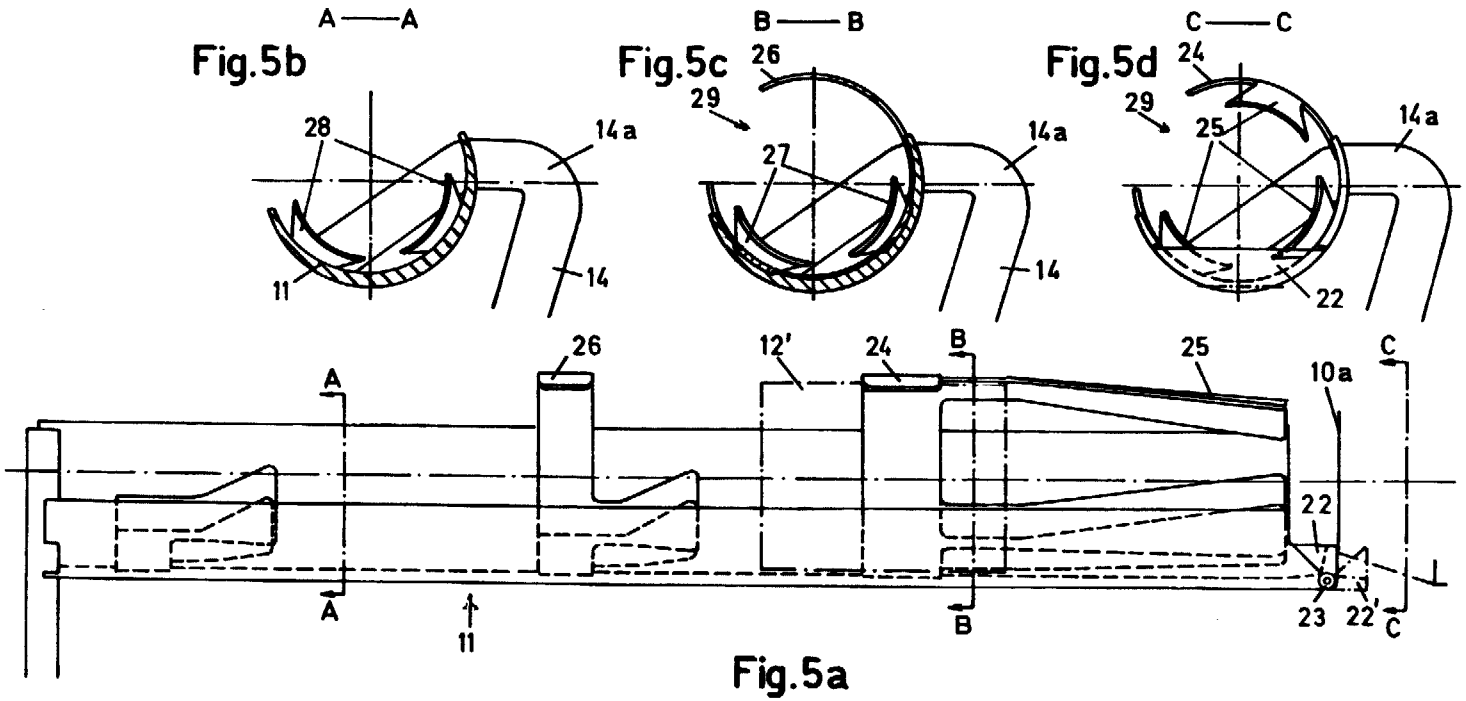
FIG. 5*a* shows a side view of a unit comprising the members according to FIG. 4.
FIGS. 5*b*–5*d* show various sections of the unit according to FIG. 5*a*.

At its rear portion, member 11 is provided with spring elements 28 of a type corresponding to spring elements 25 and 27, but which are fastened directly in the inner wall of member 11, having substantially the same length as the spring elements 27. The spring elements are relatively thin, and may be made of spring steel or the like. The axial length of the holders 24 and 26 is such that they permit the propellant charge 12 to coact with the charge retainer 15 via a remaining opening 29. The distance between the holders 24, 26 and the spring elements 25, 27, as well as the number of holders and spring elements, is specifically chosen in relation to the length of the particular propellant charges 12. In FIG. 5*a*, a comparatively small propellant charge is designated 12'.

The length of member 11 is dependent on the length of the chamber position and the possibility of ramming the projectile or shell 10 to provide free flight inside the chamber position, to obtain good ramming of the shell 10 in the origin of the rifling portion of the barrel 1 even when barrel 1 is at high elevations.

When the carrying member has achieved the insertion of the projectile to the position 10' shown in FIG. 2, member 11 is pulled rearward or reverse directions by the rammer car 13. The propellant charge 12 then makes contact with the charge retainer 15. Depending on the length of the chamber, the propellant charge may move a distance in the rearward direction before making contact with retainer 15. The charge retainer 15 coacts with a rear surface of the propellant charge 12, which has the form of a cylinder, and ensures that the propellant charge 12 assumes a defined and uniform longitudinally displaced position in the chamber. From this longitudinally displaced position the propellant charge 12 is contacted by the closing mechanism 7 so that the rear surface of the propellant charge 12 assumes a position close to the surface 7*a* of the closing mechanism 7. In its final stage, the closing movement of the closing mechanism 7 must be gentle, so that the propellant charge will not be pushed forwards by the mechanism. Such a gentle closing movement in the final stage is known with regard to closing mechanisms of the kind described. The rammer car 13 continues to its end or initial position, whereby attached member 11 is then moved to the side, out of the way of the firearm during recoil. After member 11 has been moved rearwardly from its advanced position to its end position, the loading tray 9 can be moved to the side simultaneously with member 11. The guiding devices for member 11, the loading tray 9 and the rammer car 13 can operate automatically by means of control members which are also known in themselves, with motors and operating cylinders.

Figure 6:
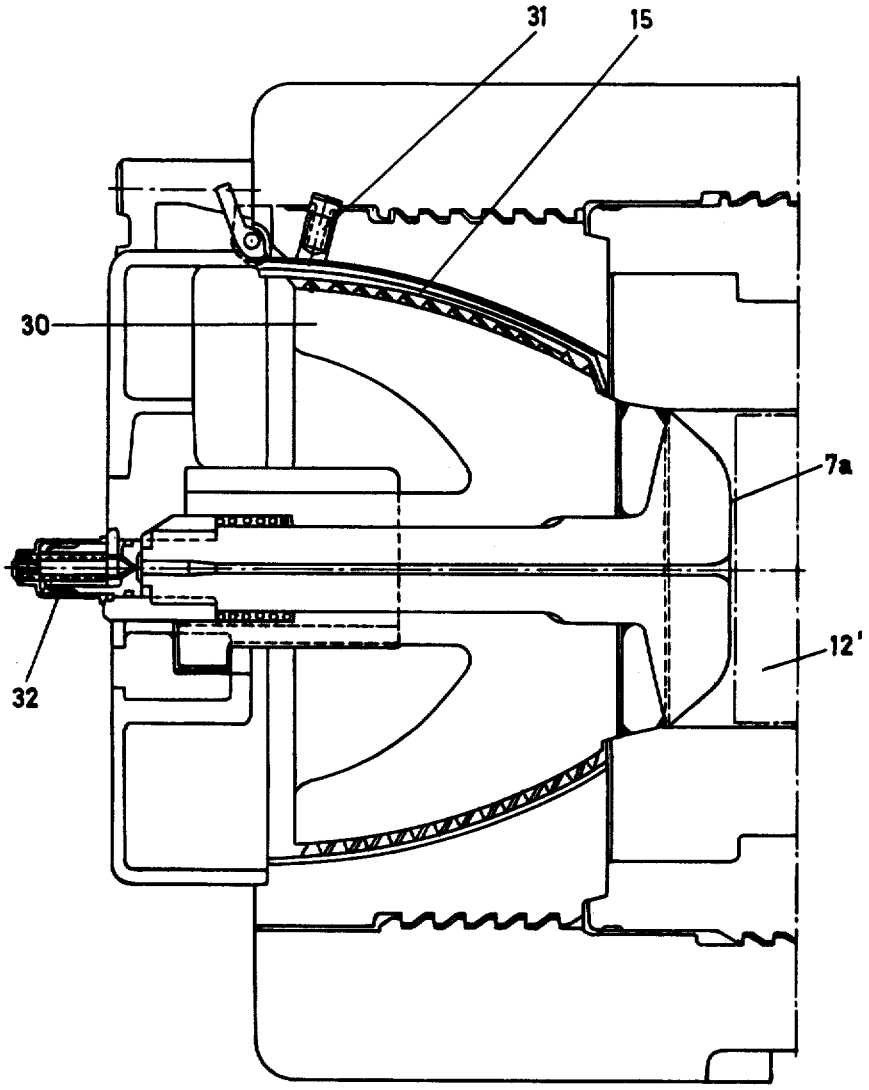
FIG. 6 shows a closing unit on the artillery weapon according to the present invention.

The charge retainer 15 can be of a conventional type, and in the preferred embodiment consists of a spring member which can be turned both in and out. When retainer 15 is turned to an outward position, it withstands forces which are directed from inside the barrel 1 and outwards, but gives way to forces in the opposite direction. FIG. 6 is intended to show such a charge retaining spring, which is known in itself, which in FIG. 6 has assumed an inwardly turned position, achieved by means of the screw mechanism 30. The charge retainer 15 is positioned in one of the open sections of the threads which occur in the type of mechanisms in question. A spring 31 is positioned to contact and move the spring 15 outwardly when the screw 30 is opened. The spring 15 is supported at one end in a hinge with a built-in stop which defines the outward limit position of the retaining spring 15. A priming cartridge is designated 32. As the other parts of the closing mechanism are not directly concerned with the invention itself, they will not be described in detail here.

In this connection, and also in general, in order to increase the uniformity of the ramming, for a distance of approx. 300 mm, nearest the origin of the rifling, the barrel has been made cylindrical, with the smallest possible diameter.

A method of loading a firearm which is made possible by the structure described above can be considered to include the steps of, positioning a propellant charge 12 in a member 11 intended for it and relative to this in the longitudinal direction of the displaceable member 11 and that the loading tray 9 with its projectile 10 positioned therein is swung in behind a firearm during the loading procedure. The procedure can, of course, take place in the reverse order. According to the new method, the member 11, after possibly having been positioned together with the loading tray 9, is displaced longitudinally forwardly in relation to the loading tray 9 so that the projectile 10 is moved by the member 11 to its position in the bore of the barrel 1 and the propellant charge 12 remaining in the member 11 is positioned behind or rearwardly of the projectile 10 in the chamber of the barrel 1. The carrying part member 11 is thereafter displaced in a longitudinally rearwardly direction in relation to the loading tray 9, and during the rearward movement of the member 11 the propellant charge 12 makes contact with a charge retainer 15 positioned at the rear portion of the barrel 1. This makes it possible to retain the propellant charge 12 in the barrel at a predetermined longitudinal position, from which the propellant charge 12 is moved to a final position by contact with an inner surface of the closing unit when this is closed. Before its initial longitudinal displacement, member 11 is swung in an arc-shaped curve in a lateral direction relative to the firearm, allowing the propellant charge 12 positioned in member 11 to assume a position in the extension of the axis of the bore of the barrel 1. During its longitudinal displacement in a forward direction, a turned-down front part 22 of member 11 contacts the rear portion 102 of the projectile 10 with projectile 10 being moved forward via part 22 of member 11. The movement forwards of member 11 stops and the projectile 10 is actuated to its final position by the kinetic energy obtained via member 11. At the stopping of member 11 in its forward movement, the propellant charge 12 is prevented from striking the projectile 10 with too great force, and thereby being destroyed, due to spring-action members arranged in member 11, which subsequently give way when the propellant charge 12 contacts the charge retainer 15 during the rearward movement of the member 11.

Briefly, the total operation is as follows. In the first phase, firing, recoiling and recuperation take place. In a second phase, turning of the chamber screw and opening of the cover in which the chamber screw is supported takes place. This is followed by ejection of the consumed priming cartridge, which is followed by turning and opening, carried out by a semi-automatic device, which starts during the recuperation, so that the passage will be free for a new round of ammunition when the weapon has reached its run-out position. The third phase consists of loading of a new priming cartridge in the primer seat in the chamber screw, which takes place automatically from a magazine for priming cartridges. The forth phase comprises ramming of a new round. In a fifth phase, the rammer is pulled out, and the propellant charge is prevented from going along by said charge retainer. In a sixth phase, the cover with the chamber screw is closed, after which the screw is turned into its locked position. During the closing of the cover, the propellant charge is actuated to its final longitudinally displaced position. Closing and turning is achieved by means of the semi-automatic device, the working springs of which are loaded up at the following recuperating movement. In a seventh and last phase, firing takes place.

The invention is not limited to the embodiments shown above as examples, but can be subject to modifications within the scope of the following claims.

We claim:

1. A method for rapidly loading a projectile and propellant charge within a firearm barrel, comprising the following steps:

loading a projectile onto a loading tray and swinging said loading tray into loading position directly behind said firearm barrel;

loading a propellant charge onto a carrying member and swinging said carrying member into loading position directly behind and partially overlapping said loading tray;

moving said carrying member toward the bore of said barrel, and pivoting a portion of said carrying member into engagement with said projectile;

moving said carrying member into a furthest position within the bore of said barrel, imparting kinetic energy from said carrying member to said projectile allowing said projectile to freely glide within said barrel until contacting a wall thereof;

withdrawing said carrying member and propellant charge mounted thereon toward a rear entrance of said bore;

separating said propellant charge from said carrying member at a pre-selected distance relative to the rear entrance of said bore; and completely removing said carrying member from said bore.

2. A method according to claim 1, including the additional step of swinging the carrying member laterally along an arc-shaped curve for positioning said propellant charge prior to loading into said barrel.

3. A method according to claim 1, including the step of imparting a frictional force against said propellant charge preventing initial separation of said charge from said carrying member.

4. An assembly for rapidly loading a projectile and a propellant charge into a firearm, and comprising:

a loading tray supporting a projectile and positionable behind the firearm barrel;

a carrying member supporting a propellant charge and positionable behind said loading tray and in overlapping contact therewith;

a rammer car assembly longitudinally movable within a cradle portion of said firearm and including a fastening arm attached to said carrying member, with movement of said rammer car in a first direction causing similar movement of said carrying member into abutment with said projectile, with further movement of said rammer car in said first direction causing said carrying member and projectile to enter said firearm barrel;

said rammer car being movable in a second, opposite direction for withdrawing said carrying member and toward a rear entrance of said firearm barrel;

retaining means extending from said carrying member and contacting said propellant charge for withdrawing said propellant charge with said carrying member toward the rear entrance of said firearm barrel; and stripper means for overcoming said retaining means and separating said propellant charge from said carrying member at a pre-selected distance relative to the rear entrance of said firearm barrel, with further movement of said rammer car in the second direction causing similar movement of said carrying member away from said firearm barrel.

5. An assembly according to claim 4, wherein said loading tray is laterally pivotable from a position on a side of said firearm to said loading position behind said barrel.

6. An assembly according to claim 4, wherein said carrying member is laterally pivotable along an arc-shaped curve from a position on a side of side firearm to said loading position behind said projectile.

7. An assembly according to claim 4, wherein a flexible stop member extends from said loading tray into contact with a rear surface of said projectile, with said stop member being displaced by contact with said carrying member during movement of said carrying arm toward said barrel.

8. An assembly according to claim 4, wherein said fastening arm extending between said rammer car and said carrying member includes a curved portion to allow said carrying member to be positioned in overlapping relationship with said loading tray.

9. An assembly according to claim 4, wherein said carrying member comprises a cradle-shaped support member for supporting said propellant charge, with said carrying member extending in a longitudinal direction of said firearm.

10. An assembly according to claim 4, wherein said retaining means comprises a flexible assembly supported by said carrying member and contacting said propellant charge to provide a frictional retaining force thereagainst.

11. An assembly according to claim 10, wherein said flexible assembly includes at least one band-shaped support member with a plurality of spring elements extending in a direction toward said projectile and frictionally contacting an outer surface of said propellant charge.

12. An assembly according to claim 10, wherein said retaining means comprises a further plurality of spring elements fastened to an inner surface of said carrying member and frictionally contacting said propellant charge.

13. An assembly according to claim 11, wherein a plurality of band-shaped support members are spaced along the longitudinal surface of said carrying member, with each band including a plurality of spring elements extending therefrom.

14. An assembly according to claim 4, wherein said carrying member traverses across the loading tray while thrusting said projectile into said barrel.

15. An assembly according to claim 4, wherein said stripper means comprises a flexible fastener extending from an inner surface of said barrel into contact with said propellant charge;

said flexible fastener being of sufficient strength to overcome said retaining means and force said propellant charge to remain at a pre-selected position within said barrel during exit of said carrying member; whereby said propellant charge is positioned adjacent a closing hatch of said barrel with said projectile being spaced therefrom.

* * * * *